United States Patent [19]

Sugita

[11] 4,095,377

[45] Jun. 20, 1978

[54] METHOD TO COMPENSATE INFEED FOR THE ERROR CAUSED BY THE OUTER DIAMETER ERROR OF A WORKPIECE IN A CENTERLESS INTERNAL GRINDER

[75] Inventor: Terumitsu Sugita, Narashino, Japan

[73] Assignee: Seiko Seiki Kabushiki Kaisha, Japan

[21] Appl. No.: 764,075

[22] Filed: Jan. 31, 1977

[51] Int. Cl.[2] ..... B24B 49/04

[52] U.S. Cl. ..... 51/290; 51/165.88; 51/165.93

[58] Field of Search ..... 51/165 R, 165.83, 165.91, 51/165.92, 165.93, 165.88, 281 R, 290

[56] References Cited

U.S. PATENT DOCUMENTS

| | | | |
|---|---|---|---|
| 1,922,093 | 8/1933 | Hutchinson | 51/165.93 |
| 2,437,783 | 3/1948 | Hutchinson | 51/165.93 X |
| 3,741,071 | 6/1973 | Hoglund | 51/165.92 X |
| 3,774,349 | 11/1973 | Uhtenwoldt | 51/165.91 |

*Primary Examiner*—Harold D. Whitehead

*Attorney, Agent, or Firm*—Robert E. Burns; Emmanuel J. Lobato; Bruce L. Adams

[57] ABSTRACT

An inprocess size measuring device has at least two feelers which respectively detect inner surface positions of an annular workpiece rotatably supported at the outer periphery thereof by a pair of shoes. The outputs from the feelers of the size measuring device are received to be converted by an operation means both into the inner diameter and into the center error of the workpiece. For this error the infeed of the infeed table is compensated.

4 Claims, 3 Drawing Figures

METHOD TO COMPENSATE INFEED FOR THE ERROR CAUSED BY THE OUTER DIAMETER ERROR OF A WORKPIECE IN A CENTERLESS INTERNAL GRINDER

BACKGROUND OF THE INVENTION

This invention relates to a method to compensate for infeed error caused by outer diameter error of a workpiece in a centerless internal grinder. This method is particularly available for a residual stock removal controlled centerless internal grinder.

In the centerless internal grinder, the workpiece is supported at the outer periphery thereof during a working operation, the periphery being used as a base surface. Accordingly, fluctuation of the outer diameters of the workpieces which are successively worked on directly causes fluctuation of the newly worked inner diameters, so that it has been required to more accurately finish the outer diameter than the inner diameter in spite of the face that the functional accuracy of the outer diameter required for the workpiece is not so high. This is a cause of reduced productivity and increased production cost.

As a recently developed infeed controlling method for a grinder, residual stock removal controlling method, the infeed table position and the workpiece size are respectively measured and the residual stock removal is detected as the difference of the two measured values. This residual stock removal is kept to a constant value suitably corresponding to the grinding conditions. This method has superior results in terms of the geometric accuracy of the finished workpiece and reduces working time.

With a centerless internal grinder using this residual stock removal controlling method, though a sizing device is provided to avoid finished size deviation on the workpieces which would directly be caused by the workpiece outer diameter fluctuations, the supporting position of the workpieces is shifted and the relative position between the infeed table and the workpiece is accordingly shifted by the workpiece outer diameter fluctuations. As a result, the residual stock removal attained from the output of the sizing device, which continuously measures the inner diameter of the workpiece during the working operation, and the output of the location detecting device for the infeed table, has some deviation from the actual residual stock removal and is equal to a supposed residual stock removal in the case of a standard outer-sized workpiece. The infeed control is carried with this supposed residual stock removal. Therefore, the worked inner bore finish of the workpieces becomes uneven because of an unexpected and unsuitable value of residual stock removal.

Therefore, there is a particular requirement for a residual stock removal method for a controlled centerless internal grinder working uneven outer diameter workpieces to detect the center position error of the workpiece on the work holder referring to the infeed table, caused by the outer diameter error of the workpiece, and to compensate the infeed of the table for the center position error so that the table infeed is controlled to to accomplish the actual predetermined residual stock removal.

SUMMARY OF THE INVENTION

Therefore, it is an object of the present invention to provide a method to compensate infeed of the infeed table for the error caused by the outer diameter error of a workpiece, by which accurate geometrical finish of the workpiece is attained.

It is another object of the invention to provide a method to compensate infeed for the error caused by outer diameter error of a workpiece, by which suitable residual stock removal is maintained without any influence of the outer diameter error.

It is a further object of the invention to provide a method to compensate infeed for the error caused by outer diameter error of a workpiece, by which intermediate steps of a grinding process, such as fine grinding infeed, are kept constant steps so that accurate and even surface finish of the workpiece is attained without excessive time loss, such as a slow grinding infeed before the grinding wheel touches the workpiece.

DETAILED DESCRIPTION OF THE PREFERRED EMBODIMENT

Figure 1:
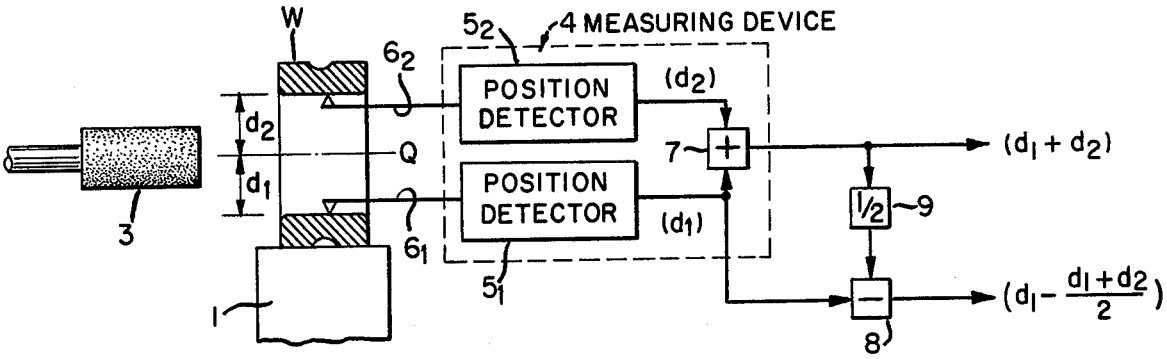
FIG. 1 is a schematic view partially block-diagrammed, showing an embodiment of the present invention.

A preferred embodiment of the invention will now be described referring to the drawings.

In FIG. 1, reference W designates a workpiece set on the work head having shoes 1 and 2, and which is mounted on an infeed table (not shown).

Figures 2A, 2B:
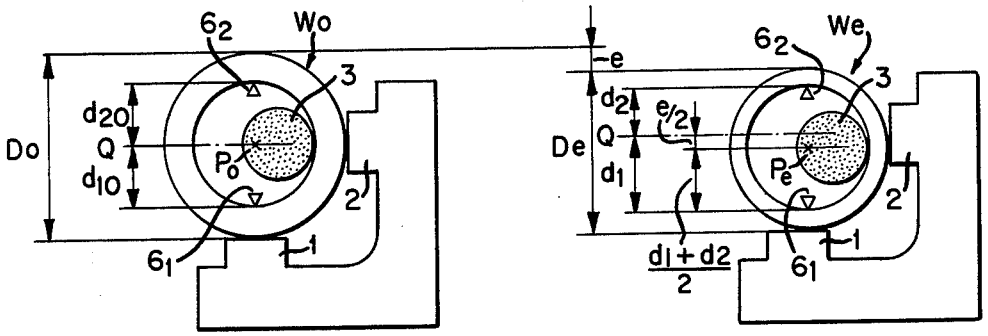
FIGS. 2A and 2B are schematic side views, respectively showing standard and outer-diameter deviated workpieces set on the shoes of the centerless internal grinder applied to the embodiment.

Workpiece W is located on shoes 1 and 2, with the outer periphery thereof as the base surface for working, and is rotated there. A grinding wheel 3 is rotating at a high speed and is inserted from one side into the bore of workpiece W, and further wheel 3 is relatively fed toward and into the bore wall of workpiece W opposite to one shoe 2 by the infeed of the infeed table, to work on workpiece W. During the grinding operation, the inner diameter of workpiece W is detected by an in-process size measuring device 4 which will be described hereinafter, and the infeed table position is detected by a location detecting device (not shown). With both the output signals of the two devices residual stock removal is determined as the difference of the infeed amount and actual metal removal on the workpiece. The infeed table is automatically controlled to keep the residual stock removal to a predetermined value. If the outer diameters of workpieces W are different from each other, as shown in FIGS. 2A and 2B, the center positions of workpieces W differ from each other referring to the shoes 1 and 2.

That is, deviation of workpiece outer diameters shifts the relative location of the workpiece W relative to the infeed table, and therefore, the residual stock removal attained from the inner diameter and the table location is not equal to the actual residual stock removal in case that the workpiece outer diameter has some deviation from the standard value.

Said size measuring device 4 has a pair of position detectors $\mathbf{5}_1$ and $\mathbf{5}_2$, such as differential transformers, wherein the outputs of the detectors are processed into the diameter and other parameters. The feelers $\mathbf{6}_1$ and $\mathbf{6}_2$ of position detectors $\mathbf{5}_1$ and $\mathbf{5}_2$ are inserted into the bore of workpiece W, each touching the inner surface in a diameter. Position detector $\mathbf{5}_1$ detects the distance $d_1$ from the base line Q to the top of feeler $6_1$, while position detector $5_2$ detects the distance $d_2$ from the base line Q to the top of feeler $6_2$. The output signals of both the position detectors $5_1$ and $5_2$ are fed to an addition circuit 7 and there added to determine the inner diameter $d_1 + d_2$ of workpiece W.

The base line Q for size measuring device 4 is determined relative to shoes 1 and 2. That is, setting a workpiece $W_o$ of outer diameter $D_o$ on shoes 1 and 2 as shown in FIG. 2A, base line Q crosses the center $P_o$ of workpiece $W_o$. It is advantageous to actually provide a workpiece $W_o$ of outer diameter $D_o$ as a master workpiece for determining zero-point on the position scale of the infeed table for the precessing use of the size measuring device.

If a workpiece $W_e$ of outer diameter $De(=D_o-e)$ is set on shoes 1 and 2 as shown in FIG. 2B, the center $P_e$ of workpiece $W_e$ is deviated by $e/2$ from center $P_o$ of workpiece $W_o$ with reference to shoes 1 and 2. The inner diameter is attained as $d_1 + d_2$ ($d_1$ means the distance from base line Q to the top of feeler $6_1$ and $d_2$ means the distance from base line Q to the top of feeler $6_2$), which is fed from said addition circuit 7. The center position error $e/2$ of center $P_e$ from base center $P_o$ may be represented as $d_1-(d_1+d_2)/2$ as is obvious in the drawing.

Feeding output signal ($d_1$) of position detector $5_1$ to one input terminal of a subtraction circuit 8 and further feeding ½ value of output signal ($d_1 + d_2$) of addition circuit 7, which is divided through an operation circuit 9, to the other input terminal of subtraction circuit 8, the center error $e/2$ of workpiece $W_e$ is attained with the computing operation $d_1-(d_1+d_2)/2$ in subtraction circuit 8. The amount of $d_1-(d_1+d_2)/2$ is directly used as the compensating amount of the infeed table, in this embodiment.

The measuring time of the center position error $e/2$ may be set to a time after some working on workpiece $W_e$, and the infeed of the infeed table is compensated for the center position error $e/2$ in the residual stock removal control thereafter. Accordingly, desirable grinding of workpiece $W_e$ is carried on maintaining a predetermined residual stock removal the same as that of the master workpiece $W_o$, to thereby decrease dispersions in geometrical and surface quality of the finished workpieces in spite of deviation of the relative position between the workpiece and the infeed table, which is caused by the workpiece outer diameter deviation.

It is also effective for improvement of geometrical and surface quality of the workpiece to apply this invention to other control methods, in which fine infeed begins at a predetermined position of the infeed table such as a constant speed infeed control, stock removal or finish allowance for fine infeed grinding being maintained constant.

If raw workpieces have inner diameter dispersion much less than that of outer diameter, the method of the invention is further effective to eliminate so called gap grinding, grinding infeed before the grinding wheel touches the workpiece surface. In this case, it is necessary to set the measuring time to immediately after the loading of the workpiece on the shoes.

It is to be understood that the method of attaining the center position error $e/2$ from position detectors is not limited to the aforementioned embodiment, but other embodiments may be available that at least two position detectors for measuring the inner surface position of a workpiece.

What is claimed;

1. A method of operating a centerless internal grinder during internal grinding of annular workpieces to compensate for variations in workpiece outer diameter from workpiece to workpiece, the internal grinder including at least two diametrically opposed position detectors each with a respective feeler, a grinding wheel, an infeed table, and a workhead mounted on said infeed table for supporing an annular workpiece on the outer peripheral surface thereof during internal grinding; the method comprising:

positioning said detectors with said feelers extending into said annular workpiece contacting an inner surface thereof during internal grinding of the annular workpiece for developing respective signals each representative of a distance between a referaxis and a point of contact between the internal surface of the annular workpiece and respective one of said feelers; developing a signal representative of center position error of the annular workpiece being internally ground caused by variation in workpiece outer diameter from workpiece to workpiece which causes center position error of the workpiece center relative to the reference axis from workpiece to workpiece; and controlling the internal grinding of the annular workpiece with the signal representative of center position error to compensate for the center position error.

2. A method according to claim 1, wherein developing a signal comprises:

summing the respective output signals from said position detectors to develop a summed signal representative of workpiece inner diameter;

developing another signal having one half the amplitude of the summed signal; and subtracting said another signal from the summed signal to develop said signal representative of center position error.

3. A method according to claim 1, wherein said workhead includes a shoe supporting a portion of the workpiece outer periphery directly opposite said grinding wheel; and wherein controlling the internal grinding of the annular workpiece comprises adjusting the infeed of said infeed table by an amount equal to said center position error.

4. A method according to claim 1, comprising measuring a master workpiece before subsequent grinding operations to define a zero or initial point on a position scale of said infeed table.

* * * * *